US006494382B1

(12) United States Patent
Stier

(10) Patent No.: US 6,494,382 B1
(45) Date of Patent: Dec. 17, 2002

(54) FUEL INJECTION VALVE

(75) Inventor: Hubert Stier, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/700,310

(22) PCT Filed: Oct. 20, 1999

(86) PCT No.: PCT/DE99/03356

§ 371 (c)(1),
(2), (4) Date: Jan. 24, 2001

(87) PCT Pub. No.: WO00/55492

PCT Pub. Date: Sep. 21, 2000

(30) Foreign Application Priority Data

Mar. 12, 1999 (DE) ..... 199 11 048

(51) Int. Cl.[7] ..... B05B 1/08

(52) U.S. Cl. ..... 239/102.1; 239/533.2; 239/585.1; 239/585.5; 239/102.2

(58) Field of Search ..... 239/102.2, 88, 239/91, 533.1, 533.2, 533.3, 533.9, 533.14, 533.11, 585.1, 585.3, 585.4, 585.5, 102.1; 251/129.05, 129.06, 129.16

(56) References Cited

U.S. PATENT DOCUMENTS 4,101,076 A 7/1978 Bart
4,579,283 A * 4/1986 Igashira et al. ..... 239/88
4,695,034 A 9/1987 Shimizu et al.
4,720,077 A 1/1988 Minoura et al.
5,743,238 A * 4/1998 Shorey et al. ..... 123/506
5,779,149 A * 7/1998 Hayes, Jr. ..... 239/124
5,984,200 A * 11/1999 Agustin ..... 239/88
5,996,910 A * 12/1999 Takeda et al. ..... 239/585.1

FOREIGN PATENT DOCUMENTS

| | | |
|---|---|---|
| DE | 17 51 543 | 8/1970 |
| DE | 195 19 192 | 6/1996 |
| EP | 0 790 402 | 8/1997 |
| JP | 02 112 664 | 4/1990 |
| JP | 03 064 662 | 3/1991 |

* cited by examiner

*Primary Examiner*—Henry C. Yuen
*Assistant Examiner*—Davis Hwu
(74) *Attorney, Agent, or Firm*—Kenyon & Kenyon

(57) ABSTRACT

A fuel injector, in particular a fuel injector for fuel-injection systems of internal combustion engines has a piezoelectric or magnetostrictive actuator, a valve closure member which can be actuated by the actuator via a valve needle and which cooperates with a valve seat face to form a sealing seat, and a translating device arranged between the actuator and the valve needle for translating an actuator lift of the actuator into a larger valve needle lift of the valve needle. In this context, the translating device includes at least one lever plate having at least one rigid lever segment running radially.

18 Claims, 3 Drawing Sheets

FUEL INJECTION VALVE

FIELD OF THE INVENTION

The present invention relates to a fuel injector.

BACKGROUND INFORMATION

A fuel injector is described in German Patent No. 195-19-192 In the case of the translating device following from this document, a piezoelectric actuator is charged for opening the valve needle. In the process, the piezoelectric actuator expands and moves a primary piston against the force of a spring. Inside the primary piston, provision is made for a secondary piston fixedly joined to a valve needle. Inside the secondary piston, provision is made for a small spring arranged between an inner surface of the primary piston and the secondary piston. A working space filled with fuel is bordered by the primary piston and the secondary piston. In this context, the working space is designed such that a change in volume of the working space can only be achieved by a movement of the primary piston and/or of the secondary piston. Therefore, the motion of the primary piston gives rise to a motion of the secondary piston. The surfaces which are effectively available for displacing the volume during a movement of the pistons can be predetermined by the diameters of primary piston and secondary piston. The translation ensues from the proportion of these surfaces.

In this known translating device, the relatively complex and not optimized design in terms of compactness is a disadvantage. Moreover, the small spring provided in the secondary piston is not sufficient to actuate the fuel injector directly. In the mentioned document, therefore, the actuation of the fuel injector takes place via an additional amplifying device. This amplifying device requires relatively a high outlay and additional space.

It is a further disadvantage that a large mass is moved to actuate the valve via the actuator and that the action of the actuator takes place via elastic and/or resilient components and pressure fluids, resulting in relatively long switching times so that the fuel injector is not suitable as a quick-switching fuel injector for high switching frequencies.

SUMMARY OF THE INVENTION

The fuel injector according to the present invention has the advantage over the background art that the simple design approach of the translating device results in an inexpensive and considerably more compact construction. Moreover, no hydraulic medium is needed. Consequently, the new design approach is also suitable for gasoline fuel which has a tendency to form bubbles. Due to rigid lever segments running radially, the lift translation is moreover of high rigidity, thus permitting high switching frequencies which is why the fuel injector can also be used as quick-switching fuel injector.

Provision is advantageously made for a plurality of lever segments which are separated from each other by openings. This first of all results in a distribution of the load on the lever segments and, secondly, the lever segments are interconnected in an advantageous manner so that the arrangement of the individual lever segments relative to one another is definitively preselected and not defined by any additional fastening. The openings moreover prevent tensions in the lever segments, which has a favorable effect on the mode of operation of the lift translation.

The lever segments advantageously have embossings preferably running form the center point of the lever plate to the edge of the lever plate. In this manner, the lever segments are additionally stiffened, as a result of even shorter switching times are rendered possible.

The lever plate is expediently composed of two different kinds of segments of which one kind of segments is formed as rigid lever segments and the other kind of segments is designed as elastic, flexible spring segments. In addition to the advantages given by the rigid lever segments and already discussed above, further particular advantages are produced by the elastic, flexible spring segments since, due to the latter, the lever plate also assumes the function of the restoring spring or the pressure spring whereby components can be economized.

Advantageously, the lever segments are attached to a thin, elastic and flexible holding disk. In this manner, the rigid lever segments can be brought into a fixed, contact-free arrangement relative to each other. Moreover, this results in special possibilities of design for the lever segments of the lever plate, these possibilities of design not being possible or only with difficulty if the lever plate is manufactured from one piece. Advantageously, the lever plate is composed of a metal sheet or of plastic, in particular polyamide, thus resulting in a gasoline-resistant, inexpensive and compact construction of the lever plate.

If the fuel injector is an inward opening fuel injector, it is advantageous that the actuator acts upon the lever segments at a middle supporting location via a tubular thrust sleeve, that the lever segments engage on the valve body at an outer supporting location, and that the lever segments act upon the valve needle at an inner supporting location. In this manner, a particularly inexpensive, space-saving, and low-maintenance embodiment of the translating device is given by the lever plate. It is an advantage if the thrust sleeve is partially encircled by the actuator, the actuator having an opening for this. Because of this, the thrust sleeve can run inside the actuator, resulting in a particularly space-saving embodiment. Moreover, the interior of the thrust sleeve can be designed as a fuel line and/or offer space for additional components such as pressure springs, restoring springs, supporting and fastening elements. It is a further advantage that thrust sleeve is enlarged on the side of the lever segments. Given a predefined distance of the inner supporting location from the valve axis, the distance of the middle supporting location from the valve axis can consequently be adjusted, thus allowing the selection of a suitable lever ratio of the translating device, whereby the ratio of valve needle lift to actuator lift can be adjusted. Thus, in particular, it is possible to achieve a suitable lever ratio even for a thrust sleeve having a very small diameter.

It is an advantage that a restoring spring acts upon the lever segments and that a pressure spring acts upon the lever segments via the valve needle in a direction opposed to the pressure spring, the pressure spring exerting a greater torque on the lever segments than the restoring spring. In this manner, the opening force on the valve needle given by force of the pressure spring on the lever segments can be adjusted during an actuation of the valve, whereby the opening speed can be adjusted via the opening movement, allowing for the actuator movement and the valve needle mass. Moreover, the restoring force acting upon the valve needle can be predefined by the force of the restoring spring. In this manner, considering the movement of the actuator and the valve needle mass, the closing speed given by the closing movement of the valve needle can be adjusted. When the fuel injector is closed, the pressure spring is blocked by the thrust sleeve via the lever segments, as a result of which the torque of the restoring spring is sufficient to press the valve needle on the valve seat against the pressure in the fuel chamber so that a sealing seat is formed. In the case of this arrangement, the opening and closing of the fuel injector is controlled only indirectly via the actuation of the actuator. In this case, the forces acting upon the valve needle for opening and closing the valve are given by the pressure spring and the restoring spring. Because of the combination with lever segments of negligible weight and a small mass of the valve needle to be actuated it is possible to implement particularly high switching frequencies.

If the fuel injector is an outward opening fuel injector, it is advantageous that the actuator acts upon the lever segments at a middle supporting location at the thrust sleeve, that the lever segments engage on the valve body at an outer supporting location, that the lever segments act upon the valve needle via an inner supporting location, and that a pressure spring acts upon the lever segments, the torque with which the pressure spring acts upon the lever segments being inversely directed to the torque and the actuator acts upon the lever segments. The lift translation of an actuator lift of the actuator into a valve needle lift of the valve needle can be favorable selected in this manner. During the closing of the valve upon the completed actuation of the actuator, the advantage ensues that the valve needle, which is pressed against the lever segments by the restoring force of the restoring spring, does not experience any radial force at the inner supporting location and is consequently pressed against the valve seat in a distortion-free manner, possibly with the aid of suitable needle guides.

DETAILED DESCRIPTION

Figure 1:
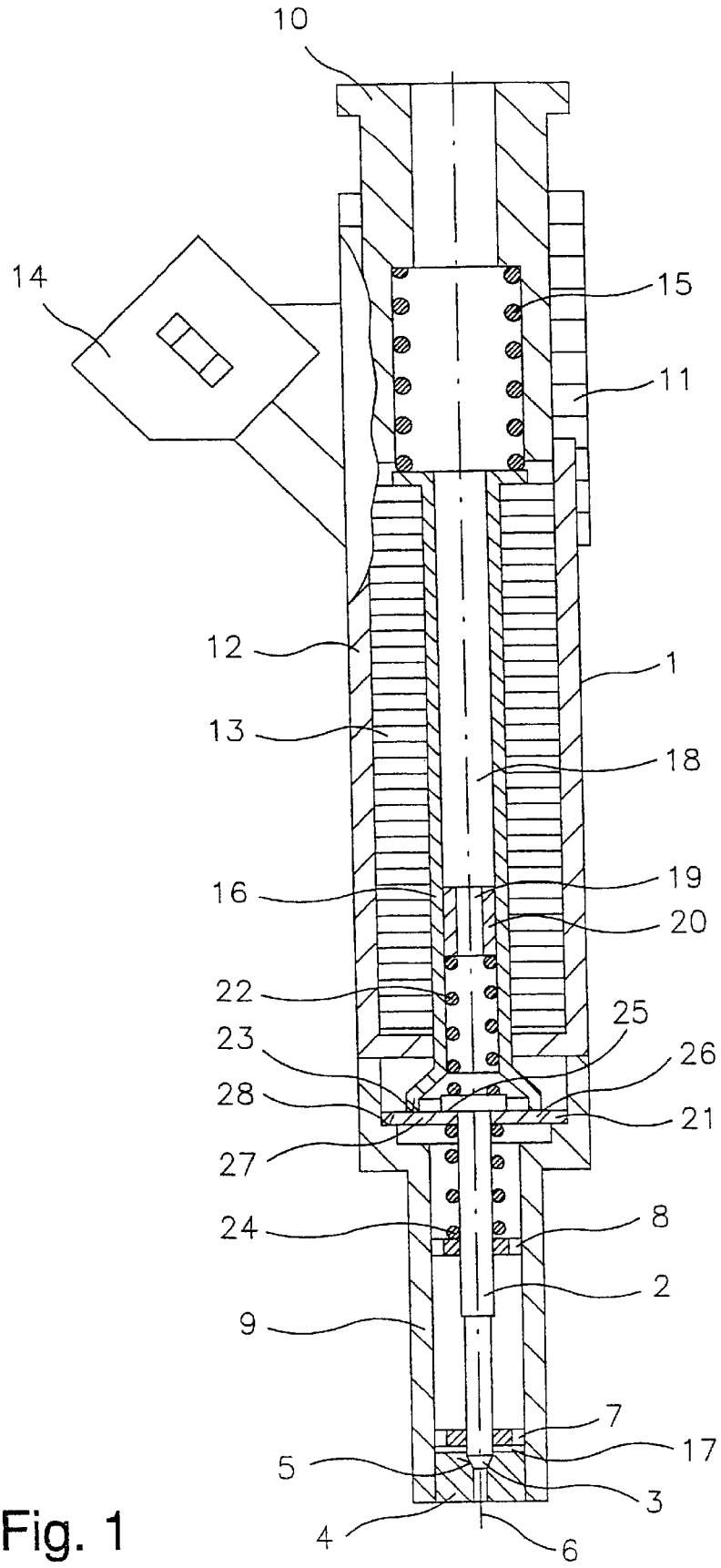
FIG. 1 shows, in part, an axial section through a first exemplary embodiment of a fuel injector according to the present invention having a translating device, the fuel injector being designed as an inward opening fuel injector.

FIG. 1 shows, in part, an axial sectional view of a fuel injector 1 according to the present invention. Fuel injector 1 is designed as an inward opening fuel injector 1. Fuel injector 1 serves as a so-called "gasoline direct injector" in particular for directly injecting fuel, in particular gasoline, into the combustion chamber of a mixture-compressing internal combustion engine with externally supplied ignition. However, fuel injector 1 according to the present invention is also suitable for other application cases.

Fuel injector 1 has a valve closure member 3 which can be actuated by a valve needle 2. In the exemplary embodiment, valve closure member 3 is formed in one piece with valve needle 2. Valve closure member 3 has a frustoconical design, the frustrum of cone tapering in the spray direction. Valve closure member 3 cooperates with a valve seat face 5 formed at a valve seat body 4 to form a sealing seat. Valve needle 2 is guided by valve needle guides 7, 8 during its movement along valve axis 6. Valve seat body 4 and valve needle guides 7, 8 are located in a front portion of a valve body 9 at the spray end. The supply of the fuel takes place via a fuel connection 10 located in the rear portion of valve body 11.

Used for actuating fuel injector 1 is an actuator 13 which is provided in the middle portion of valve body 12 and which can have a piezoelectric or magnetostrictive design. The actuation of actuator 13 is carried out via an electrical control signal. The electric supply lead required for this is to be connected to fuel injector 1 via a connecting socket 14 in the rear portion of valve body 11. When actuated, actuator 13 expands and acts upon a tubular thrust sleeve 16 in the middle portion of valve body 12 against the force of a preloading spring 15 in the rear portion of valve body 1l. During the actuation of actuator 13, tubular thrust sleeve 16 therefore moves in the direction of fuel connection 10 into the rear portion of valve body 11.

The fuel supply into a fuel chamber 17 is composed in that provision is made for an inner fuel duct 18 in tubular thrust sleeve 16, for an inner fuel duct 19 in a tubular supporting element 20, for suitable passages in a lever plate 21 and/or in the part of tubular thrust sleeve 16 facing lever plate 21 and in valve needle guide 7, 8, through which the fuel is fed into fuel chamber 17.

In the closed condition of fuel injector 1, a restoring spring 22 located inside tubular thrust sleeve 16 acts upon valve needle 2 so that frustoconical valve closure member 3 of valve needle 2 is pressed against valve seat face 5 of valve seat 4, as result of which no fuel can escape from fuel chamber 17 into the combustion chamber of an internal combustion engine. In this context, a preloading spring 15 in the rear portion of valve body 11 acts upon lever plate 21 at a middle supporting location 23 via tubular thrust sleeve 16 in the middle portion of valve body 12 in such a manner that, without actuating actuator 13, a pressure spring 24 acting upon lever plate 21 is blocked by tubular thrust sleeve 16. In this context, pressure spring 24 acts upon valve needle 2 at an inner supporting location 25 via lever plate 21. Restoring spring 22, at the end facing away from valve needle 2, engages on tubular supporting element 20 which is fixedly mounted in tubular thrust sleeve 16.

To inject the fuel into the combustion chamber of an internal combustion engine, fuel injector 1 is actuated via actuator 13. As described above, tubular thrust sleeve 16 moves in the direction of the rear portion of valve body 11 in response to the actuation of actuator 13, as a result of which tubular thrust sleeve 16 no longer acts against pressure spring 24 via lever plate 21. Since pressure spring 24 acts upon lever plate 21 with a greater torque than restoring spring 22, lever segments 26, 27 of lever plate 21 are tilted, lever segments 26, 27 being braced against outer supporting location 28 at the front portion of valve body 9 at the spray end. During the tilting of lever segments 26, 27 of lever plate 21, valve needle 2, which is guided by valve needle guides 7, 8, moves along valve axis 6 in the direction of fuel connection 10, as a result of which frustoconical valve closure member 3 lifts off valve seat face 5 of valve seat 4 and clears the sealing seat. The arising gap between valve closure member 3 and valve seat 4 causes fuel to issue from fuel chamber 17 of fuel injector 1 into the combustion chamber of the internal combustion engine.

Upon the disconnection of actuator 13, preloading spring 15 acts upon lever segments 26, 27 of lever plate 21 at middle supporting location 23 via tubular thrust sleeve 16, the torque which is generated by preloading spring 15 and which acts upon lever plate 21 being greater than the torque generated by pressure spring 24 so that lever segments 26, 27 of lever plate 21 are restored to their initial position, lever segments 26, 27 being braced against outer supporting location 28 at the front portion of valve body 9 at the spray end. Because of this, pressure spring 24 no longer acts upon valve needle 2 at inner supporting location 25 via lever plate 21. Restoring spring 22 which, at its end facing the rear portion of valve body 11, is braced against tubular supporting element 20 inside tubular thrust sleeve 16, moves valve needle 2 back into its closing position, in which valve closure member 3 forms a sealing seat with valve seat body 4 at valve seat face 5, and the outflow of fuel from fuel chamber 17 into the combustion chamber of the internal combustion engine is consequently interrupted. By varying the axial position of tubular supporting element 20, an adjustable prelaod can be applied to restoring spring 22 so that the contact pressure given by restoring spring 22 for pressing valve closure member 3 of valve needle 2 against valve seat face 5 of valve seat body 4 can be adjusted.

Figure 2:
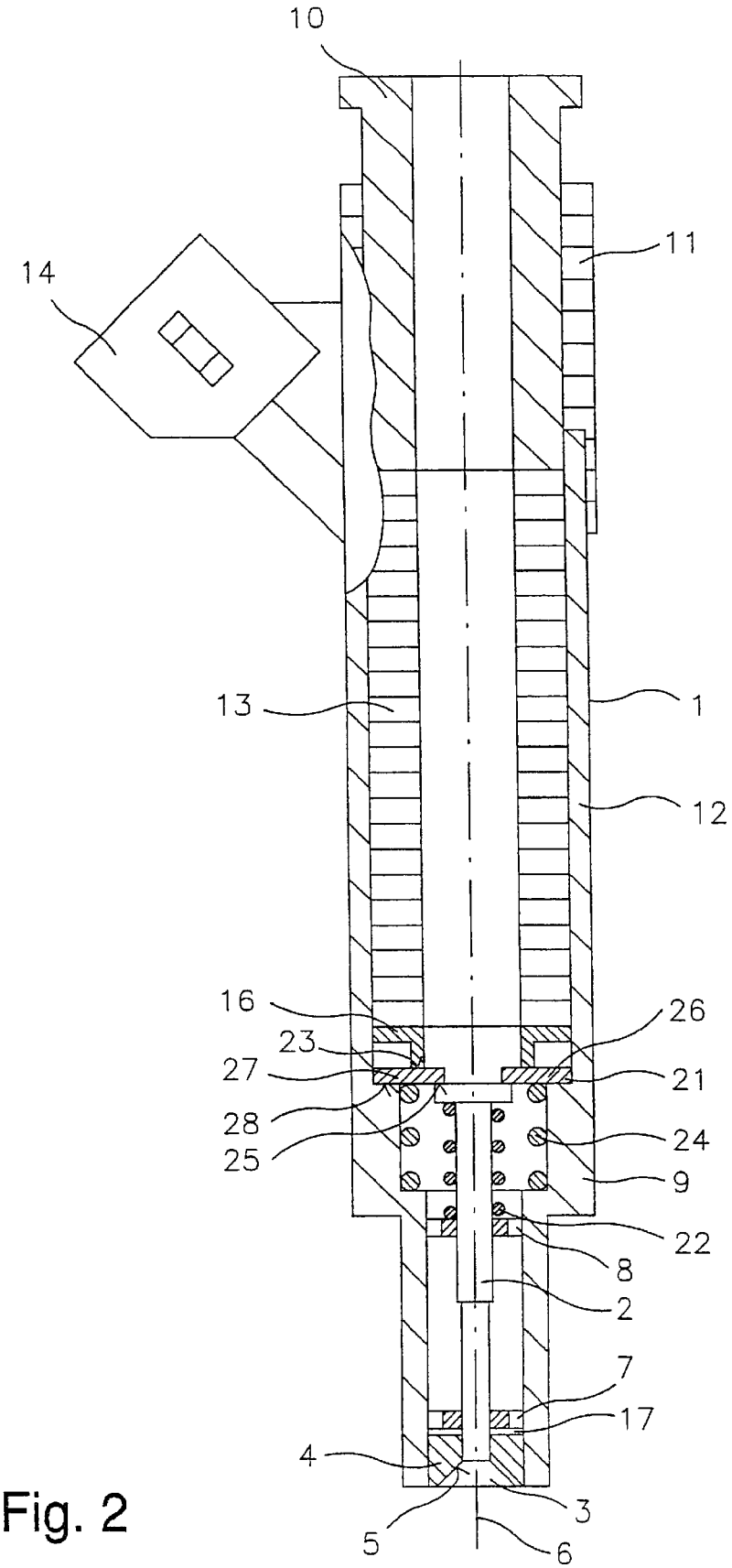
FIG. 2 shows, in part, an axial section through a second exemplary embodiment of a fuel injector according to the present invention, the fuel injector being designed as an outward opening fuel injector.

FIG. 2 shows, in part, an axial sectional view of a second exemplary embodiment of a fuel injector 1 according to the present invention. Unlike the exemplary embodiment shown in FIG. 1, this exemplary embodiment is an outward opening fuel injector 1. Already described elements are provided with identical reference symbols. In this respect, a repetitive description is dispensed with.

In the case of this exemplary embodiment, the actuator lift of actuator 13 during the actuation of fuel injector 1 takes place in the direction of the front portion of valve body 9, as a result of which actuator 13 acts directly upon lever plate 21 at middle supporting location 23 via tubular thrust sleeve 16. Preloading spring 15 from FIG. 1 can therefore be omitted. Since frustoconical valve closure member 3, which widens in the spray direction, needs to be pressed in the direction of the rear portion of valve body 11 against valve seat body 4 at valve seat face 5 for closing fuel injector 1, restoring spring 22 acts upon valve needle 2 with a force along valve axis 6 in the direction of the rear portion of valve body 11. In the process, it is possible for restoring spring 22 to be directly braced against valve needle guide 8, or provision can also be made for an additional supporting element. Pressure spring 24 acts upon lever segments 26, 26 of lever plate 21 at middle supporting location 23 in the same manner as in FIG. 1.

For actuating fuel injector 1, actuator 13 is actuated, the actuator expanding and acting upon lever plate 21 at middle supporting location 23 via tubular thrust sleeve 16 and moving against the restoring force of restoring spring 22, since the torque which is generated by the actuator force of actuator 13 and which acts upon lever segments 26, 26 is greater than the torque which acts upon lever segments 26, 26 of lever plate 21 through the force of restoring spring 22, as a result of which lever segments 26, 26 act upon valve needle 2 at inner supporting location 25 and move the valve needle along valve axis 6 in the direction of valve seat body 4, whereby frustoconical valve closure member 3 lifts off valve seat body 4 at valve seat face 5 and clears the sealing seat. The gap arisen between valve closure member 3 and valve seat 4 causes fuel to issue from fuel chamber 17 of fuel injector 1 into the combustion chamber of the internal combustion engine.

Upon the disconnection of actuator 13, pressure spring 24 acts upon lever segments 26, 26 of lever plate 21, restoring them to their initial position. Because of this, actuator 13 no longer acts upon valve needle 2 at inner supporting location 25 via tubular thrust sleeve 16 and via lever plate 21, as a result of which restoring spring 22 restores valve needle 2 along valve axis 6 in the direction of the rear portion of valve body 11, and frustoconical valve closure member 3 is consequently pressed against valve seat body 4 at valve seat face 5. Corresponding to the embodiment of FIG. 1, the contact pressure for pressing valve closure member 3 against valve seat face 5 of valve seat body 4 can be adjusted by the axial position of valve needle guide 8.

Figure 3:
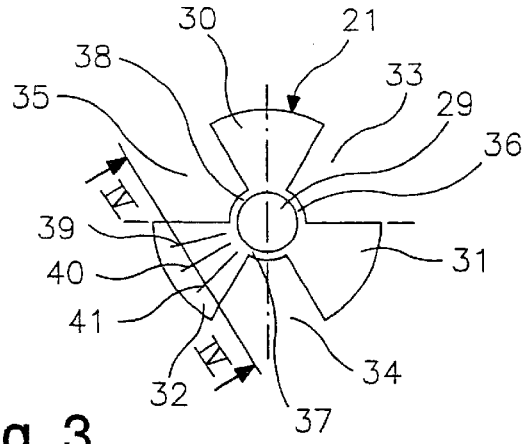
FIG. 3 shows a front view of a lever plate, which is used in the exemplary embodiments shown in FIGS. 1 and 2, in an enlarged representation.

FIG. 3 shows the front view of an exemplary embodiment of lever plate 21 according to the present invention. Lever plate 21 has an inner opening 29, lever segments 30, 31, 32 which are separated from each other by outer openings 33, 34, 35, as well as connecting links 36, 37, 38 of which each holds together two of lever segments 30, 31, 32, respectively. When tilting lever segments 30, 31, 32, which are arranged relative to each other in a manner that they are spaced from each other for example by 120°, tensions are produced in connecting links 36, 37,38. Lever segments 30,31,32 have for example the shape of sectors of a circle. Due to inner opening 29, the tensions in connecting links 36, 37, 38 are reduced. Inner opening 29 and outer openings 33, 34, 35 can also serve as fuel passage. Lever segments 30, 31, 32 have a rigid design which can be achieved by the material thickness of lever segments 30, 31, 32 and/or by radially running embossings 39, 40,41, which are exemplarily indicated in FIG. 3 only on one lever segment 32. The shape of inner opening 29, of outer openings 33, 34, 35 is not limited to the represented shape and number; lever segments 30, 31, 32 are not limited to the shown number; and embossings 39, 40, 41 are not limited to the represented shape and number either. Moreover, not all lever segments 30, 31, 32 of a lever plate 21 necessarily have to have the same kind of stiffening.

For a clearer representation, lever segments 30, 31, 32 are marked by embossings 39, 40,41 in the following Figures. To simplify the representation and the description, in each case only three lever segments 30, 31, 32 are depicted such as in FIG. 3.

Figure 4:
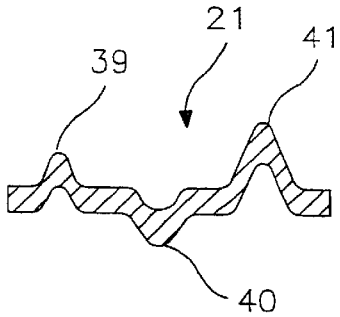
FIG. 4 shows a section through a lever segment which has embossings and which is a segment of the lever plate along line IV—IV in FIG. 3.

FIG. 4 shows the section which is laid through lever segment 32 of lever plate 21 in FIG. 3 and which is marked by the line of section denoted by IV—IV. Embossings 39, 40, 41 can be applied both on the same side, such as embossing 39 and embossing 41, and on opposite sides, such as embossings 39 and 40. Moreover, the embossings can be developed both to the same extent, such as embossing 39 and embossing 40, and to a different extent, such as embossings 40 and 41.

Figure 5:
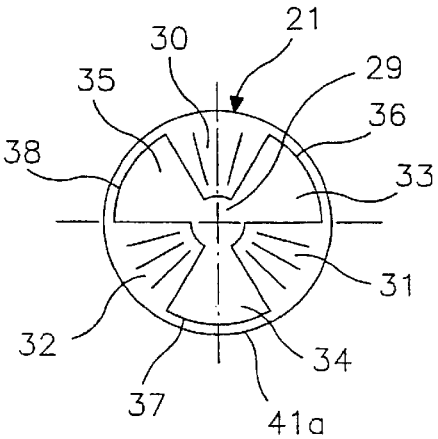
FIG. 5 shows a further exemplary embodiment of the lever plate, the lever segments being separated from each other by openings.

FIG. 5 shows the front view of an alternative embodiment of lever plate 21 according to the present invention. Already described elements are provided with identical reference symbols. In this respect, a repetitive description is dispensed with. Inner opening 29 and outer openings 33, 34, 35 are not separated from each other in this exemplary embodiment. Lever segments 30, 31, 32 of lever plate 21 are interconnected by connecting links 36, 37, 38 running peripherally at outer edge 41 a of lever plate 21. In contrast to lever segments 30, 31, 32 from FIG. 3, lever segments 30, 31, 32 are therefore tilted inward.

Figure 6:
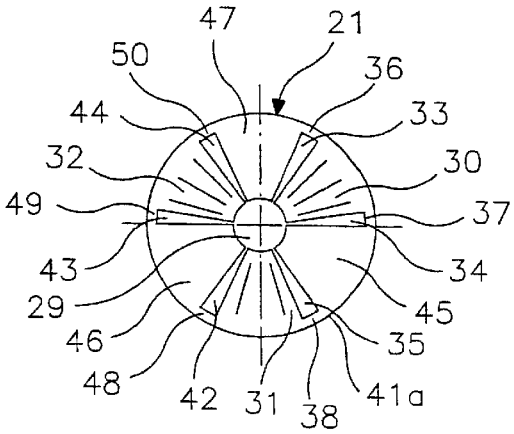
FIG. 6 shows a further exemplary embodiment of the lever plate, elastic, flexible spring segments being also provided in addition to the rigid lever segments.

FIG. 6 shows the front view of an further exemplary embodiment of lever plate 21 according to the present invention. Already described elements are provided with identical reference symbols. Lever plate 21 has an inner opening 29 and outer, slit-like openings 33, 34, 35, 42, 43, 44 which extend radially in the form of a star and which are interconnected. Resulting segments 30, 31, 32, 45, 46, 47 of lever plate 21 are subdivided in two different kinds of segments 30, 31, 32, 45, 46, 47 of which one kind of segments is formed as rigid lever segments 30, 31, 32, and the other kind of segments is designed as elastic, flexible spring segments 45, 46, 47. In this context, the segments are held together by connecting links 36, 37, 38, 48, 49, 50 located at outer edge 41a of lever plate 21.

Figure 7:
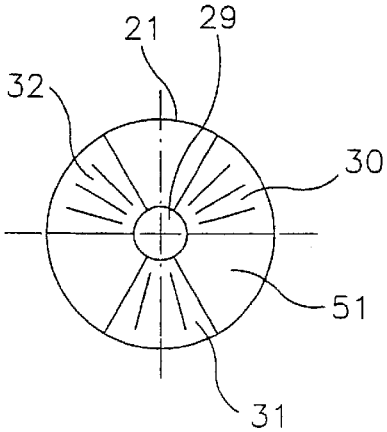
FIG. 7 shows a further exemplary embodiment of the lever plate, the lever segments being attached to a holding disk.

FIG. 7 shows the front view of a further alternative exemplary embodiment of lever plate 21 according to the present invention. Already described elements are provided with identical reference symbols. In this exemplary embodiment, lever segments 30, 31, 32 of lever plate 21 are not held together by connecting links but are attached to a thin, elastic and flexible holding disk 51. An inner opening 29 can be provided in thin, elastic and flexible holding disk 51, enabling thin, elastic and flexible holding disk 51 to better bend or allowing fuel to pass through it. In this context, thin, elastic and flexible holding disk 51 is made of a gasoline-resistant material as for example sheet metal or a plastic material such as polyamide.

What is claimed is:

1. A fuel injector, comprising:

a structure including one of a piezoelectric actuator and a magnetostrictive actuator;

a valve needle;

a valve seat face;

a valve closure member capable of being actuated by the one of the piezoelectric actuator and the magnetostrictive actuator via the valve needle the valve closure member cooperating with the valve seat face to form a sealing seat; and a translating device arranged between the valve needle and the one of the piezoelectric actuator and the magnetostrictive actuator, the translating device translating an actuator lift of the one of the piezoelectric actuator and the magnetostrictive actuator into a larger valve needle lift of the valve needle, wherein:

the translating device includes at least one lever plate that includes at least one rigid lever segment running radially, and the at least one rigid lever segment responds to the actuator lift by moving the valve needle.

2. The fuel injector according to claim 1, wherein:

the fuel injector corresponds to a fuel injector for a fuel-injection system of an internal combustion engine.

3. The fuel injector according to claim 1, wherein:

each of the at least one rigid lever segment is separated from each other by openings.

4. The fuel injector according to claims 1, wherein:

each one of the at least one rigid lever segment includes an embossing.

5. The fuel injector according to claim 4, wherein:

each embossing runs form a center point of the at least one lever plate to an/edge of the at least one lever plate.

6. A fuel injector, comprising:

a structure including one of a piezoelectric actuator and a magnetostrictive actuator;

a valve needle;

a valve seat face;

a valve closure member capable of being actuated by the one of the piezoelectric actuator and the magnetostrictive actuator via the valve needle, the valve closure member cooperating with the valve seat face to form a sealing seat; and a translating device arranged between the valve needle and the one of the piezoelectric actuator and the magnetostrictive actuator, the translating device translating an actuator lift of the one of the piezoelectric actuator and the magnetostrictive actuator into a larger valve needle lift of the valve needle, wherein:

the translating device includes at least one lever plate that includes at least one rigid lever segment running radially, and the at least one lever plate includes:

a plurality of segments of a first kind formed as rigid lever segments, and a plurality of segments of a second kind formed as elastic, flexible spring segments.

7. The fuel injector according to claim 6, further comprising:

a thin, elastic, and flexible holding disk to which are attached the rigid lever segments.

8. The fuel injector according to claim 7, wherein:

the holding disk includes a metal sheet.

9. The fuel injector according to claim 7, wherein:

the holding disk includes a plastic material.

10. The fuel injector according to claim 9, wherein:

the plastic material includes polyamide.

11. A fuel injector, comprising:

a structure including one of a piezoelectric actuator and a magnetostrictive actuator;

a valve needle;

a valve seat face;

a valve closure member capable of being actuated by the one of the piezoelectric actuator and the magnetostrictive actuator via the valve needle, the valve closure member cooperating with the valve seat face to form a sealing seat;

a translating device arranged between the valve needle and the one of the piezoelectric actuator and the magnetostrictive actuator, the translating device translating an actuator lift of the one of the piezoelectric actuator and the magnetostrictive actuator into a larger valve needle lift of the valve needle, wherein the translating device includes at least one lever plate that includes at least one rigid lever segment running radially;

a tubular thrust sleeve; and a valve body, wherein:

the at least one rigid lever segment includes a set of lever segments, the fuel injector is an inward opening fuel injector, the one of the piezoelectric actuator and the magnetostrictive actuator acts upon the set of lever segments at a middle supporting location via the tubular thrust sleeve, the set of lever segments engages on the valve body at an outer supporting location, and the set of lever segments acts upon the valve needle at an inner supporting location.

12. The fuel injector according to claim 11, wherein:

the one of the piezoelectric actuator and the magnetostrictive actuator includes an opening by which the tubular thrust sleeve is encircled at least partially by the one of the piezoelectric actuator and the magnetostrictive actuator.

13. The fuel injector according to claim 11, wherein:

the tubular thrust sleeve is enlarged on a side of the set of lever segments.

14. The fuel injector according to claim 11, wherein:

a mean distance of the outer supporting location from a valve axis is greater than a mean distance of the middle supporting location from the valve axis, and the mean distance of the middle supporting location from the valve axis is greater than a mean distance of the inner supporting location from the valve axis.

15. The fuel injector according to claim 11, further comprising:

a pressure spring acting upon the set of lever segments;

a restoring spring acting upon the set of lever segments via the valve needle in a direction opposed to that of the pressure spring, wherein:

the pressure spring exerts a greater torque on the set of lever segments than the restoring spring.

16. A fuel injector, comprising:

a structure including one of a piezoelectric actuator and a magnetostrictive actuator;

a valve needle;

a valve seat face;

a valve closure member capable of being actuated by the one of the piezoelectric actuator and the magnetostrictive actuator via the valve needle, the valve closure member cooperating with the valve seat face to form a sealing seat;

a translating device arranged between the valve needle and the one of the piezoelectric actuator and the magnetostrictive actuator, the translating device translating an actuator lift of the one of the piezoelectric actuator and the magnetostrictive actuator into a larger valve needle lift of the valve needle, wherein the translating device includes at least one lever plate that includes at least one rigid lever segment running radially;

a thrust sleeve;

a valve body; and a pressure spring, wherein:

the at least one rigid lever segment includes a set of lever segments, the fuel injector is an outward opening fuel injector, the one of the piezoelectric actuator and the magnetostrictive actuator acts upon the set of lever segments at a middle supporting location via the thrust sleeve, the set of lever segments engages on the valve body at an outer supporting location, and the set of lever segments acts upon the valve needle via an inner supporting location, the pressure spring acts upon the set of lever segments, and a torque with which the pressure spring acts upon the set of lever segments is inversely directed to a torque with which the one of the piezoelectric actuator and the magnetostrictive actuator acts upon the set of lever segments.

17. The fuel injector according to claim 16, wherein:

a mean distance of the outer supporting location from a valve axis is greater than a mean distance of the middle supporting location from the valve axis, and a mean distance of the middle supporting location from the valve axis is greater than a mean distance of the inner supporting location from the valve axis.

18. The fuel injector according to claim 16, further comprising:

a restoring spring acting upon the valve needle, wherein:

a force with which the restoring spring acts upon the valve needle is inversely directed to a force with which the set of lever segments acts upon the valve needle.

* * * * *